US009142198B2

(12) United States Patent
Suenaga

(10) Patent No.: US 9,142,198 B2
(45) Date of Patent: Sep. 22, 2015

(54) SILENCER

(71) Applicant: Yamaha Corporation, Hamamatsu-Shi, Shizuoka-Ken (JP)

(72) Inventor: Yuichiro Suenaga, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 10 days.

(21) Appl. No.: 14/176,456

(22) Filed: Feb. 10, 2014

(65) Prior Publication Data

US 2014/0224097 A1 Aug. 14, 2014

(30) Foreign Application Priority Data

Feb. 13, 2013 (JP) ..... 2013-025136

(51) Int. Cl.
*G10D 9/06* (2006.01)

(52) U.S. Cl.
CPC ..... *G10D 9/06* (2013.01)

(58) Field of Classification Search
CPC ..... G10D 7/10; G10D 9/02; G10D 9/00; G10D 9/043; G10D 3/00; G10K 11/16; G10G 7/00
USPC ..... 84/380 R, 387 R, 400
See application file for complete search history.

(56) References Cited

U.S. PATENT DOCUMENTS

| | | | |
|---|---|---|---|
| 738,472 | A | 9/1903 | Neumann |
| 1,546,258 | A | 7/1925 | Schluesselburg |
| 1,578,763 | A | 3/1926 | Schluesselburg |
| 1,702,561 | A | 2/1929 | Santa Emma |
| 1,767,974 | A | 6/1930 | Godbery |
| 1,855,423 | A | 4/1932 | Sansone |
| 2,108,769 | A | 2/1938 | Humes |
| 3,322,015 | A | 5/1967 | Berg |
| 3,760,679 | A | 9/1973 | Gossick et al. |
| 4,178,829 | A | 12/1979 | Wolford |
| 4,273,022 | A | 6/1981 | Bell |
| 5,973,246 | A | 10/1999 | Hamanaga et al. |
| 2013/0047818 | A1 | 2/2013 | Hamanaga |

FOREIGN PATENT DOCUMENTS

| | | | |
|---|---|---|---|
| BR | 7100605 | U | 6/1991 |
| EP | 0 712 112 | A2 | 5/1996 |
| EP | 0 712 112 | A3 | 12/1998 |
| GB | 2 086 636 | A | 5/1982 |
| JP | S63-132999 | U | 8/1988 |
| JP | H08-194473 | A | 7/1996 |
| JP | 2865030 | B2 | 3/1999 |

(Continued)

OTHER PUBLICATIONS

Extended European Search Report issued for corresponding application EP 14 15 4453, mailing date Jun. 12, 2014.

*Primary Examiner* — Kimberly Lockett
(74) *Attorney, Agent, or Firm* — Dickstein Shapiro LLP

(57) ABSTRACT

A silencer includes: a hollow main body to be inserted in a bell of a wind instrument and including (a) a rear end portion serving as an opening portion and (b) a front end portion serving as a closing portion; and a flow-path adjuster supported by the main body in the bell and configured to narrow a path through which a breath of a player of the wind instrument is delivered into the main body. The front end portion of the main body is located near a frontmost portion of the bell or at a rear of the frontmost portion in a state in which the main body in mounted in the bell.

19 Claims, 4 Drawing Sheets

(56) References Cited

FOREIGN PATENT DOCUMENTS

| | | | | | |
|---|---|---|---|---|---|
| JP | 2000-231377 | A | | 8/2000 | |
| JP | 2004-240347 | A | | 8/2004 | |
| JP | 3552026 | B2 | | 8/2004 | |
| JP | 2008-096498 | A | | 4/2008 | |
| JP | 2008096498 | A | * | 4/2008 | ..... 84/380 R |
| JP | 4986091 | B1 | | 7/2012 | |

* cited by examiner

SILENCER

CROSS REFERENCE TO RELATED APPLICATION

The present application is based on Japanese Patent Application No. 2013-025136 filed on Feb. 13, 2013, the contents of which are incorporated herein by reference.

BACKGROUND OF THE INVENTION

1. Field of the Invention

The present invention relates to a silencer.

2. Description of the Related Art

A common silencer is a cylindrical member having a space therein and has a closed front end portion and a rear end portion in which is formed an opening communicating with the space. In general, this kind of silencer is used by being inserted from a rear-end side thereof into a bell that is a sound radiating portion of a brass instrument. When the silencer is mounted on the bell, a substantial length of a pipe of the brass instrument (i.e., the length of the pipe which determines a wavelength of a standing wave of a sound or a note) changes, resulting in generation of pitch distortion of a played note. In order to reduce the pitch distortion as small as possible, there has been used a silencer whose front end portion projects frontward from the bell in the state in which the silencer is mounted on the brass instrument (see Japanese Patent No. 3552026, for example).

SUMMARY OF THE INVENTION

Incidentally, some players of brass instruments want to carry their brass instruments with silencers being mounted thereon. However, it is difficult to carry the brass instrument in a state in which the silencer projects from an end surface of the bell. Also, in a case of a brass instrument such as a trumpet whose pipe body is lifted by hands of a player during playing, the silencer projecting from the end portion of the bell makes it difficult for the player to play the instrument.

This invention has been developed in view of the above-described situations, and it is an object of the present invention to provide a silencer (including a mute) which does not project frontward from an end surface of a bell in a state in which the silencer is mounted on a brass instrument and which is capable of reducing pitch distortion in that state to a degree causing no problem in practical use.

The object indicated above may be achieved according to the present invention which provides a silencer comprising: a hollow main body to be inserted in a bell of a wind instrument and comprising a rear end portion serving as an opening portion, and a front end portion serving as a closing portion; and a flow-path adjuster supported by the main body in the bell and configured to narrow a path through which a breath of a player of the wind instrument is delivered into the main body, wherein the front end portion of the main body is located in a vicinity of a frontmost portion of the bell or at a rear of the frontmost portion in a state in which the main body in mounted in the bell.

In the above-described construction, even in the case where the front end portion of the main body of the silencer is located in the vicinity of the frontmost portion of the bell or at a rear of the frontmost portion, pitch distortion can be adjusted by the pitch adjuster so as to fall within a range causing no problem in practical use. Accordingly, it is possible to provide a silencer in which the pitch distortion falls within a practically allowable range and which is containable in the bell without projecting from an end surface of the bell.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1A:
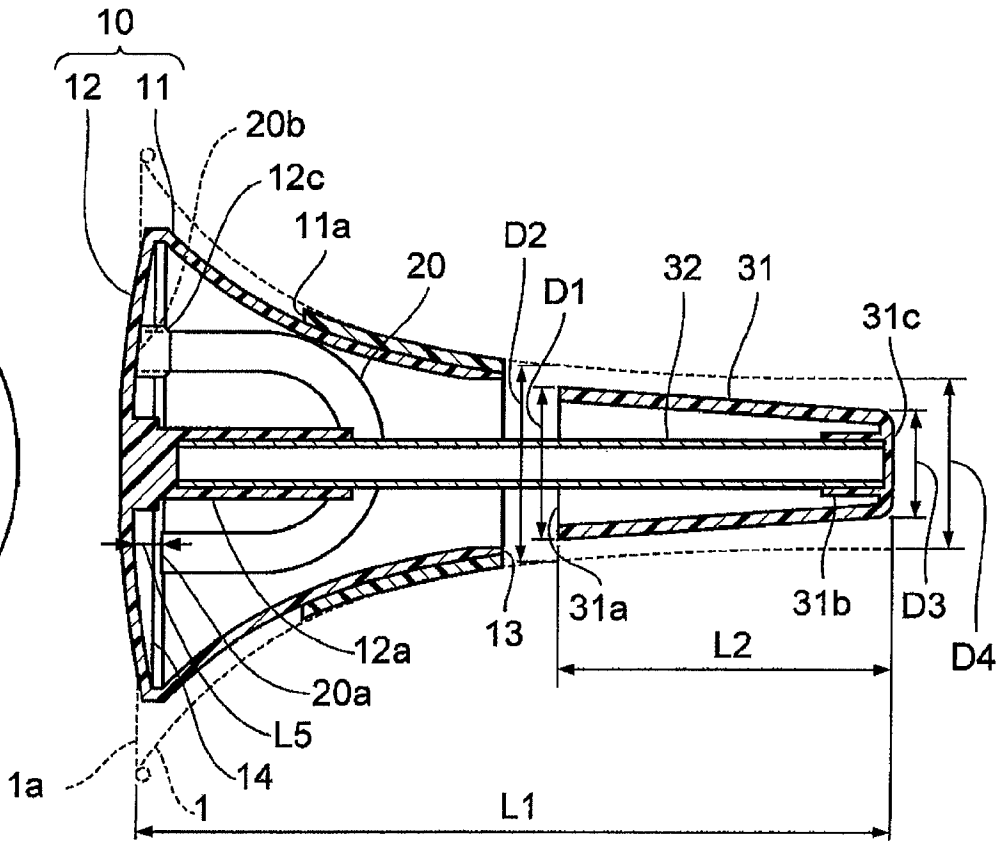
FIGS. 1A and 1B are views illustrating a construction of a silencer according to one embodiment of the present invention.
Figure 1B:
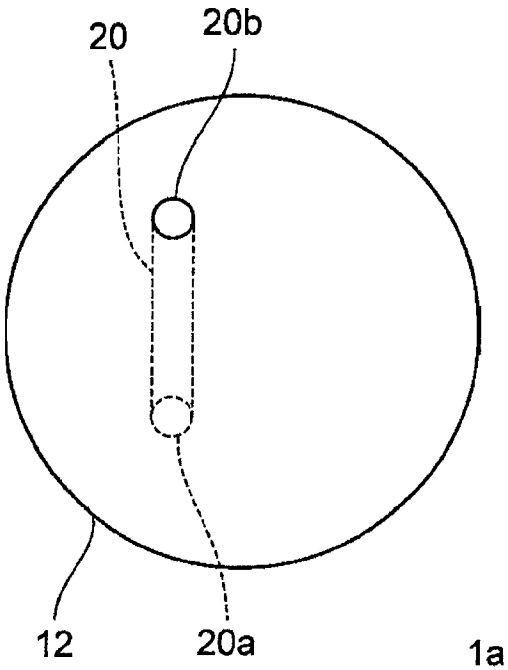

Hereinafter, there will be described one embodiment of the present invention by reference to the drawings. FIG. 1A is an elevational view in vertical cross section illustrating a silencer according to the present embodiment which is mounted on a bell 1 of a trumpet as a brass instrument, taken along an axis of a pipe of the trumpet. FIG. 1B is a front elevational view illustrating the silencer. In FIG. 1A, on the right side of the bell 1 is a mouth, not shown, of a player who plays the brass instrument. In the following explanation, front and rear sides are defined according to a direction in which the player is looking. For example, in FIG. 1A, the diameter of the bell 1 increases toward the front side and decreases toward the rear side.

As illustrated in FIGS. 1A and 1B, the silencer according to the present embodiment includes: a main body 10 constituted by a cylindrical portion 11 and a closing portion 12 for closing a front portion of the cylindrical portion 11; and a pitch adjuster 31 (as one example of a flow-path adjuster) mounted at a rear of the main body 10.

The cylindrical portion 11 is formed of a plate member having a generally conical trapezoid shape. Like the bell 1, the diameter of the cylindrical portion 11 gradually increases toward the front side such that the inclination of an outer wall surface of the cylindrical portion 11 with respect to an axis of the bell 1 increases. This cylindrical portion 11 has: a front end portion 14 whose inside diameter is the largest in the cylindrical portion 11; and a rear end portion 13 whose inside diameter is the smallest in the cylindrical portion 11. The closing portion 12 is connected to the front end portion 14, and the rear end portion 13 is open. The closing portion 12 is formed of a plate member whose outer surface has a generally bowl shape. That is, the main body 10 is a hollow member whose front portion is constituted by the closing portion 12 and whose rear portion has an opening.

Wound around an outer circumferential surface of the cylindrical portion 11 is a shock absorber 11*a* formed of resin such as a sponge having a large coefficient of friction. This shock absorber 11*a* is for securing the main body 10 to the bell 1 to prevent the main body 10 from falling out of the bell 1. In the present embodiment, the shape and the size of the outer circumferential surface of the cylindrical portion 11 are determined such that the closing portion 12 as a front end portion of the main body 10 is located at a front end portion of the bell 1 in a state in which the cylindrical portion 11 is secured in the bell 1, with the shock absorber 11*a* being sandwiched between the outer circumferential surface of the cylindrical portion 11 and an inner circumferential surface of the bell 1.

The object of the present embodiment is to prevent deterioration of a capability of coinciding a pitch of a played note with a requested pitch in the state in which the silencer is mounted, that is, the object of the present embodiment is to prevent deterioration of the intonation. The pitch adjuster 31 is provided to prevent the deterioration of the intonation.

A boss 12*a* is formed on a center of an inner surface of the closing portion 12 (i.e., a point of intersection of the axis of the cylindrical portion 11 and the closing portion 12). The boss 12*a* is shaped like a column for securing a rod 32. The boss 12*a* is located inside the main body 10 and extends along the axis of the cylindrical portion 11. The boss 12*a* has a circular cylindrical hole whose axis coincides with the axis of the cylindrical portion 11. The rod 32 is formed of metal such as aluminum and shaped like a cylinder. The rod 32 is fitted in the hole of the boss 12*a* and secured in a state in which the rod 32 extends along the axis of the cylindrical portion 11.

The pitch adjuster 31 is formed of a plate member having a generally conical trapezoid shape whose outside diameter increases from the rear side toward the front side. The pitch adjuster 31 has: a rear end portion 31*c* (as one example of a first rear end portion) whose outside diameter is the smallest in the pitch adjuster 31; and a front end portion 31*a* (as one example of a first front end portion) whose outside diameter is the largest in the pitch adjuster 31. The rear end portion 31*c* is closed, and the front end portion 31*a* is open. Formed on the rear end portion 31*c* of the pitch adjuster 31 is a boss 31*b* that is shaped like a column for securing the rod 32. The boss 31*b* is located in the pitch adjuster 31 and extends along the axis of the pitch adjuster 31. The boss 31*b* has a circular cylindrical hole having an axis coinciding with the axis of the pitch adjuster 31. The rod 32 is fitted in the boss 31*b*. The pitch adjuster 31 is supported by the rod 32 in a state in which the axial direction of the pitch adjuster 31 coincides with that of the rod 32. The flow-path adjuster 31 is detachably attached to the rod 32. In view of the above, the pitch adjuster 31 is detachably attached to an inner wall of the front end portion of the main body 10.

FIG. 1A illustrates a state in which the pitch adjuster 31 is mounted on the main body 10 with the rod 32. When supplied into the bell 1, a breath blown by a player from a mouthpiece passes through an area located between an inner wall or surface of the bell 1 and an outer wall or surface of the pitch adjuster 31 and is delivered into the main body 10 of the silencer. Here, since the pitch adjuster 31 extends in a radial direction of the bell 1 from its axis, the cross-sectional area of a path of the breath delivered into the main body 10 through the inside of the bell 1 is smaller in the area located between the inner wall of the bell 1 and the outer wall of the pitch adjuster 31 than in other areas (i.e., an area in the bell 1 which differs in a front and rear direction from the area on which the pitch adjuster 31 is disposed). Thus, the pitch adjuster 31 serves as an enlarging portion whose outer circumferential surface facing the inner wall of the bell 1 projects outward from the axis of the bell 1 to reduce the cross-sectional area of the path of the breath between the outer circumferential surface of the enlarging portion and the inner wall of the bell 1. It is noted that when the breath is supplied by the player with his or her lips placed on the mouthpiece mounted on the trumpet, a sound wave generated by vibrations of the lips of the player propagates. This sound wave generates a standing wave in the trumpet, and the generated standing wave determines a pitch of a sound or note emitted from the trumpet. That is, the change in the cross-sectional area of the path of the breath results in changes in the cross-sectional area of a path through which the sound wave propagates.

The pitch adjuster 31 prevents the deterioration of the intonation in the case where the silencer is mounted in the bell 1. That is, the pitch adjuster 31 corrects distortion of the pitch of the played note which occurs because the closing portion 12 is disposed at the end portion of the bell 1. In other words, the pitch adjuster 31 corrects a difference or a deviation between a pitch produced in a case where the trumpet is played without the silencer mounted and a pitch produced in the case where the trumpet is played with the silencer mounted. More specific explanation is provided below.

First, it is assumed that a standing wave having a sound pressure waveform similar to that produced in the case where the silencer is not mounted exists in the bell 1 in a construction in which a front end portion of the silencer projects from the end portion of the bell as in the conventional technique.

Here, when the front end portion of the silencer is moved to the end portion of the bell 1, the waveform of the standing wave in the bell 1 becomes a waveform which is obtained by compressing the waveform of the standing wave in the axial direction of the bell 1, so that a pitch of a sound produced in the bell 1 rises.

Accordingly, in the present embodiment, the pitch adjuster 31 is disposed at a position located at a rear of the closing portion 12 in the bell 1 in the axial direction of the bell 1 and spaced apart from the closing portion 12 by a predetermined distance. In an area in which this pitch adjuster 31 is disposed, the cross-sectional area of the path of the breath (i.e., the path through which the sound wave propagates) for supplying the breath (i.e., the sound wave) of the player of the brass instrument into the main body 10 is smaller than that in the other areas. In this area in which the cross-sectional area of the path of the breath (i.e., the path through which the sound wave propagates) is reduced, the velocity of flow of the breath (i.e., the velocity of the sound wave) is higher than that in the other areas. Thus, in the bell 1, a standing wave having sound pressure nodes is easily generated near the area in which the pitch adjuster 31 is disposed. Since the pitch adjuster 31 is provided in the present embodiment as described above, the sound pressure nodes of the standing wave which are generated in the bell 1 is brought closer to the end portion of the bell 1. This corrects the distortion of the pitch of the played note which occurs because the closing portion 12 is disposed at the end portion of the bell 1.

An intonation in the state in which the silencer is mounted is affected by various parameters including: the position of the closing portion 12 as the front end portion of the silencer in the axial direction of the bell 1; a distance L1 from the inner wall of the closing portion 12 to a rear end of the pitch adjuster 31; a length L2 of the pitch adjuster 31 in the axial direction of the bell 1; an outside diameter D1 of the front end portion of the pitch adjuster 31; and an outside diameter D3 of the rear end portion of the pitch adjuster 31. In order to appropriately correct pitch distortion due to mounting of the silencer, these parameters need to be appropriately set according to the shape of the bell 1 and a practical range of the brass instrument that uses the silencer.

Figure 2A:
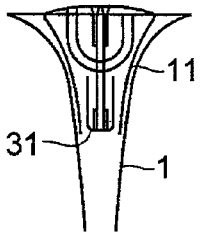
FIGS. 2A-2C are elevational views in vertical cross section each illustrating an example of arrangement of an interval adjuster in the embodiment.
Figure 2B:
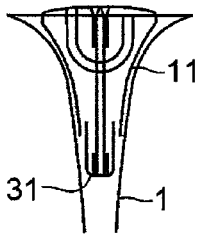
Figure 2C:
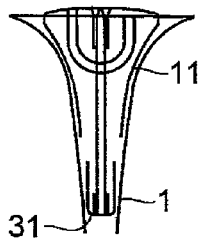

To satisfy these needs, the rods 32 having various lengths and the pitch adjusters 31 having various outside diameters D1, D3 can be used in the present embodiment. Accordingly, a player only needs to select the rod 32 having an appropriate length according to, e.g., the shape of the bell 1 and the practical range of the brass instrument that uses the silencer, then mount the rod 32 on the closing portion 12, and then mount the pitch adjuster 31 that is appropriate for the rod 32. FIG. 2A illustrates an example in which the pitch adjuster 31 is disposed inside the cylindrical portion 11. FIG. 2B illustrates an example in which the pitch adjuster 31 is disposed expanding over the inside of the cylindrical portion 11 and the inside of the bell 1. FIG. 2C illustrates an example in which the pitch adjuster 31 is located outside the cylindrical portion 11 and inside the bell 1.

It is noted that a relationship among the shape of the bell 1 and the practical range of the brass instrument that uses the silencer, an appropriate position of the closing portion 12 (i.e., the front end portion of the silencer) on the axis of the bell 1 in the state in which the silencer is mounted, an appropriate position of the pitch adjuster 31 on the axis of the bell 1, and an appropriate diameter of the pitch adjuster 31 will be described later.

A performance adjustment pipe 20 is a hollow circular cylindrical pipe having a generally U-shape in its entirety, and two ends of the performance adjustment pipe 20 are open. As illustrated in FIG. 1B, a first end portion 20*a* of the performance adjustment pipe 20 is open inside the main body 10 of the silencer. A second end portion 20*b* of the performance adjustment pipe 20 is open to an outside of the main body 10 of the silencer. Specifically, the closing portion 12 includes a boss 12*c* which has a hole extending through front and rear surfaces of the closing portion 12. The second end portion 20*b* of the performance adjustment pipe 20 is inserted into the hole of the boss 12C, so that the performance adjustment pipe 20 is secured. The second end portion 20*b* of the performance adjustment pipe 20 which is inserted in the boss 12*c* is open to the outside of the main body 10. The first end portion 20*a* of the performance adjustment pipe 20 does not reach the closing portion 12. That is, the first end portion 20*a* is spaced apart from the inner wall of the closing portion 12 and is open toward the inner wall of the closing portion 12.

This performance adjustment pipe 20 plays three roles. The first role is to discharge, to the outside, the breath blown by the player into the bell 1 and the silencer. When the breath of the player is supplied from the pipe of the trumpet into the main body 10, the breath supplied into the main body 10 is delivered to the first end portion 20*a* of the performance adjustment pipe 20. The breath delivered from the first end portion 20*a* into the performance adjustment pipe 20 is discharged from the second end portion 20*b* of the performance adjustment pipe 20 to the outside of the main body 10.

The second role of the performance adjustment pipe 20 is to reduce unnecessary peaks generated in a spectral distribution of a sound pressure wave in the bell 1 and the silencer.

In the silencer in the present embodiment, there are sound waves of direct sounds traveling toward the closing portion 12 and sound waves of reflected sounds reflected from the closing portion 12 and traveling toward the mouthpiece. The sound waves of the direct sounds and the sound waves of the reflected sounds exist also near the first end portion 20*a* of the performance adjustment pipe 20 which opens in the silencer. Accordingly, in a case where twice a distance L5 between the first end portion 20*a* and the inner wall of the closing portion 12 (i.e., a difference between the length of a path for the direct sound and the length of a path for the reflected sound) is equal to an odd-numbered multiple of a half-wavelength of the sound wave or an integral multiple of a wavelength, the sound waves of the direct sounds and the sound waves of the reflected sounds interfere with each other, so that the sound waves are made excessively small or large. As a result, sound waves having dips and peaks at specific frequencies related to the distance between the first end portion 20*a* and the inner wall of the closing portion are output from the performance adjustment pipe 20.

In the present embodiment, the first end portion 20*a* is disposed near the closing portion 12 to prevent generation of dips and peaks in sounds in an audible range. That is, when the first end portion 20*a* of the performance adjustment pipe 20 is disposed in the main body of the silencer, the performance adjustment pipe 20 is mounted on the main body 10 in the state in which the first end portion 20*a* is located near the closing portion 12. In the construction in which the first end portion 20*a* is disposed near the closing portion 12, frequencies at dips and peaks (i.e., specific frequencies related to a distance between the first end portion 20*a* and the closing portion 12) fall outside the audible range. Specifically, by setting the distance between the first end portion 20*a* and the closing portion 12 at several millimeters, no interference occurs in the audible range. That is, to make the difference in length of path (i.e., twice the distance between the first end portion 20*a* and the closing portion 12) a half of a wavelength, the distance between the first end portion 20*a* and the closing portion 12 needs to be determined at a quarter of the wavelength. Assuming that an upper limit frequency of sounds in the audible range is 10 kHz and that a sound velocity is 340 m/s, the wavelength is 0.034 m (=340/10000). Since a quarter of this wavelength is 8.5 mm, in a case where the distance between the first end portion 20*a* and the closing portion 12 is less than 8.5 mm, sounds having mannerisms at dips and peaks in the sound waves within the audible range are not output from the performance adjustment pipe 20. Also, assuming that the upper limit frequency of sounds in the audible range is 20 kHz and that the sound velocity is 340 m/s, the wavelength is 0.017 m (=340/20000). Since a quarter of this wavelength is 4.25 mm, in a case where the distance between the first end portion 20*a* and the closing portion 12 is less than 4.25 mm, sounds having mannerisms at dips and peaks in the sound waves within the audible range are not output from the performance adjustment pipe 20. Accordingly, a high-performance silencer can be provided.

The third role of the performance adjustment pipe 20 is to stabilize sound waves generated in the bell 1 and the silencer. When the player plays the trumpet using the silencer, the player produces a sound by vibrating air existing between the mouthpiece and the silencer. In a case where there is an acoustic resistor (which is a material providing an acoustic resistance) in the silencer, vibrations of air are less freely generated, stabilizing sound waves to be produced in the silencer. In the silencer according to the present embodiment, since the performance adjustment pipe 20 is provided inside the main body 10, the sound waves generated in the bell 1 and the silencer can be easily stabilized when compared with the case where the performance adjustment pipe 20 is not provided.

A characteristic of the present embodiment is that the pitch adjuster 31 corrects pitch distortion. As described above, the position of the closing portion 12 (i.e., the front end portion of the silencer) on the axis of the bell 1 in the state in which the silencer is mounted, the position of the pitch adjuster 31 on the axis of the bell 1, the diameter of the pitch adjuster 31 need to be appropriately selected according to the shape of the bell 1 and the practical range of the brass instrument that uses the silencer, in order to appropriately correct the pitch distortion.

Here, the correction of pitch distortion is explained. The position of the pitch adjuster 31 on the axis of the bell 1 is determined based on the practical range of the brass instrument that uses the silencer. Specifically, the lower the practical range of the brass instrument that uses the silencer, the longer the distance L1 in FIG. 1A is made to move the position of the pitch adjuster 31 rearward from the end portion of the bell 1. For example, a practical range of a trombone is lower than that of a trumpet by one octave. Accordingly, in a silencer for the trombone, the pitch adjuster 31 is disposed generally on an inner side in the bell 1 (i.e., on a rear side or a right side in FIG. 1A) than the pitch adjuster 31 of the silencer for the trumpet. Also, the lower the practical range of the brass instrument that uses the silencer, the longer the length L2 of the pitch adjuster 31 is made in the axial direction of the bell 1.

A relationship between the position of the closing portion 12 and the diameters D1, D3 of the pitch adjuster 31 is as follows. In the case where the closing portion 12 is located near the end of the bell 1 or on an inner side of the end of the bell 1 in the bell 1, pitches of played notes in the state in which the pitch adjuster 31 is not provided are generally high with respect to pitches of notes produced in the case where the trumpet is played without the silencer mounted. To solve this problem, the pitch adjuster 31 is used, and the diameters D1, D3 of the pitch adjuster 31 are made larger to reduce the cross-sectional area of an air column extending along the axis of the bell 1 (i.e., an air column extending through an area located between the outer wall of the pitch adjuster 31 and the inner wall of the bell 1). This construction can lower pitches of the practical range of the brass instrument that uses the silencer by some degree.

Figure 3:
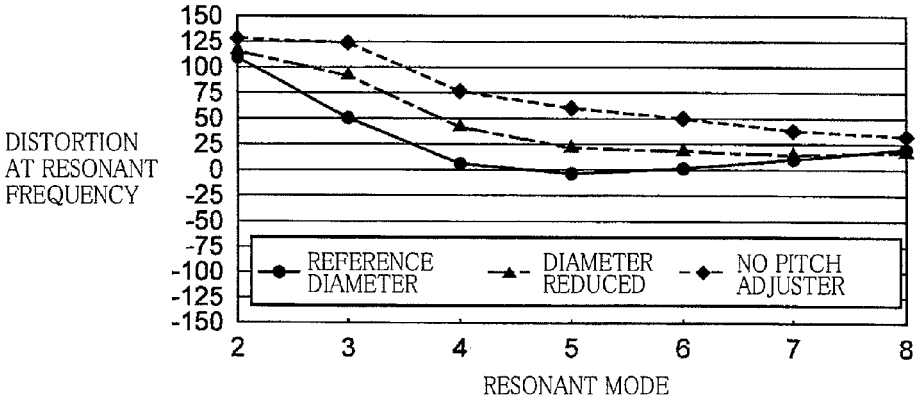
FIG. 3 is a view illustrating changes in intonation in a case where the diameter of the pitch adjuster is reduced in the embodiment.
Figure 4:
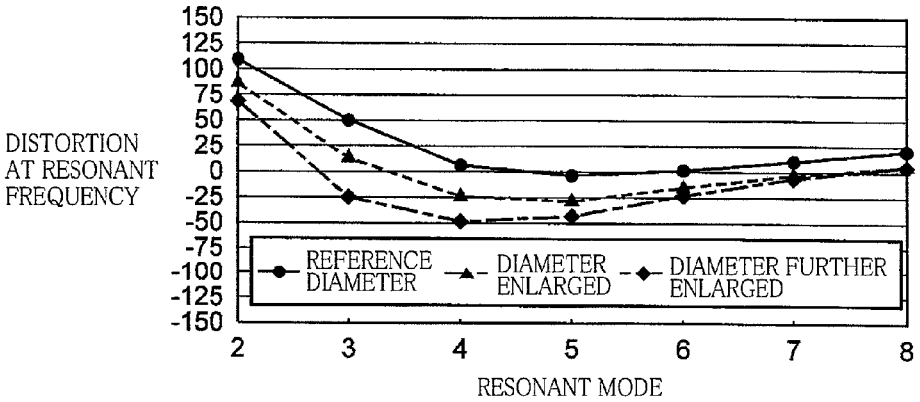
FIG. 4 is a view illustrating changes in intonation in a case where the diameter of the pitch adjuster is enlarged in the embodiment.
Figure 5:
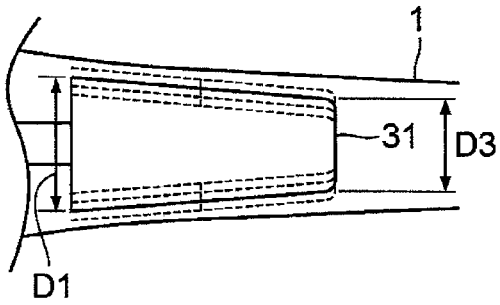
FIG. 5 is an elevational view in vertical cross section illustrating an example of changes of the diameter of the pitch adjuster in the embodiment.

FIGS. 3 and 4 are graphs each representing changes in intonation in the silencer for the trumpet in a case where the diameters D1, D3 of the pitch adjuster 31 are changed as illustrated in FIG. 5. In FIGS. 3 and 4, the horizontal axis represents the order of a resonant mode of the trumpet. The vertical axis represents, in cents (a cent is a hundredth of a semitone), a displacement or a difference of a resonant frequency caused in the case where the silencer is being mounted with respect to a resonant frequency caused in the case where the silencer is not mounted in each resonant mode. FIG. 3 illustrates changes in intonation in a case where the diameters D1, D3 of the pitch adjuster 31 are respectively determined at 26.5 mm and 18.1 mm as a reference state, in a case where the diameters D1, D3 are reduced by 4 mm from those in the reference state, and in a case where the pitch adjuster 31 is omitted. FIG. 4 illustrates changes in intonation in the case where the diameters D1, D3 of the pitch adjuster 31 are determined at those in the reference state, in a case where the diameters D1, D3 are enlarged by 1 mm from those in the reference state, and in a case where the diameters D1, D3 are enlarged by 2 mm from those in the reference state. It is noted that, to determine the intonation in these cases, the parameters L1, L2, D2, and D4 illustrated in FIG. 1A are set as follows: L1=134 mm, L2=58 mm, D2=32.64 mm, and D4=25.53 mm.

In the case of the trumpet, the practical range generally falls within a range ranging from the second mode to the eighth mode. As illustrated in FIG. 3, pitches generally rise when the diameters D1, D3 of the pitch adjuster 31 are reduced from those in the reference state to enlarge the cross-sectional area of the air column extending along the axis of the bell 1 through the area located between the outer wall of the pitch adjuster 31 and the inner wall of the bell 1. The pitches further rise in the case where the pitch adjuster 31 is not provided. Also, the pitches or an interval changes more greatly with respect to the changes in the diameters D1, D3 in a midrange mode than in a lower-order mode and a higher-order mode.

As illustrated in FIG. 4, pitches generally fall when the diameters D1, D3 of the pitch adjuster 31 are enlarged from those in the reference state to reduce the cross-sectional area of the air column extending along the axis of the bell 1 through the area located between the outer wall of the pitch adjuster 31 and the inner wall of the bell 1. If the diameter D of the pitch adjuster 31 is excessively enlarged, however, pitches excessively fall relatively in the midrange mode.

Though not illustrated, when the cross-sectional area of the air column extending through the area located between the outer wall of the pitch adjuster 31 and the inner wall of the bell 1 becomes smaller than the cross-sectional area of a straight portion of a pipe of the brass instrument (i.e., a portion of the pipe which is nearer to the mouthpiece and which has a fixed cross-sectional area), the operation of the trumpet is changed to an operation thereof in a acoustically closed state, making the pitches generally higher. Alternatively, even though the operation of the trumpet has not been changed to the operation thereof in the acoustically closed state, pitches may excessively fall only in midrange frequencies though pitches in low and high frequencies do not fall. Also, excessive reduction of the cross-sectional area of the air column extending along the axis of the bell 1 deteriorates a blowing sensation due to, e.g., friction between air and the inner wall surface of the bell 1. Thus, there is a limit in a degree of reduction of the cross-sectional area of the air column.

In a case where a player actually plays the trumpet on which the silencer is mounted, the player can play the trumpet with not only the pitches in the graphs illustrated in FIGS. 3 and 4 but also other pitches. At low frequencies in the second and third modes in particular, a skilled player can adjust tension in his or her lips to keep proper pitches in some degree. If distortion at a resonant frequency is excessively far from zero, however, even the skilled player has difficulty in making a correction to the proper pitches. Accordingly, to improve intonation produced by the player and the brass instrument, pitch distortion is preferably reduced for the entirety of the practical range by determining the diameters D1, D3 of the pitch adjuster 31 at appropriate ones.

In a case where the intonation does not fall within the practical range even when the cross-sectional area of the air column is reduced to the limit by the pitch adjuster 31, pitches are adjusted by moving the closing portion 12 forward to enlarge a volume in an area extending from the closing portion 12 to the pitch adjuster 31. This adjustment reduces an amount of rise of pitches at low frequencies, eliminating a need to reduce the cross-sectional area of the air column to the limit by the pitch adjuster 31.

Figure 6:
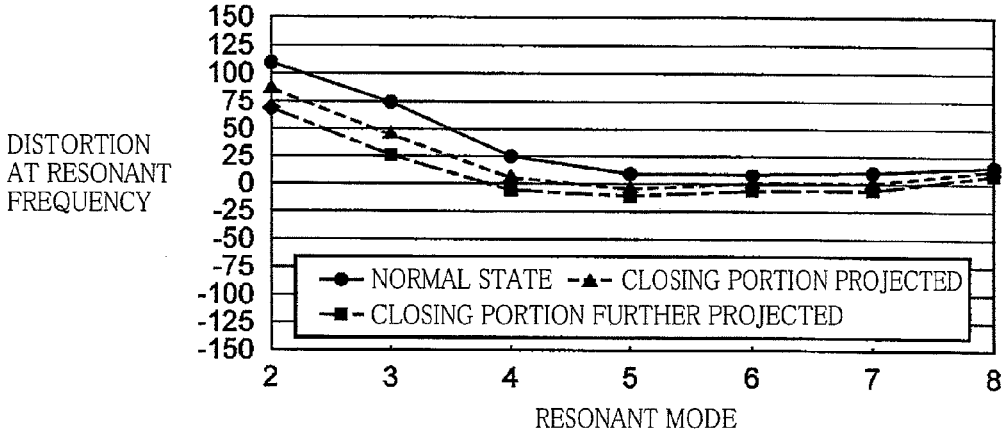
FIG. 6 is a view illustrating changes in intonation in a case where a position of the closing portion is changed in the embodiment.
Figure 7:
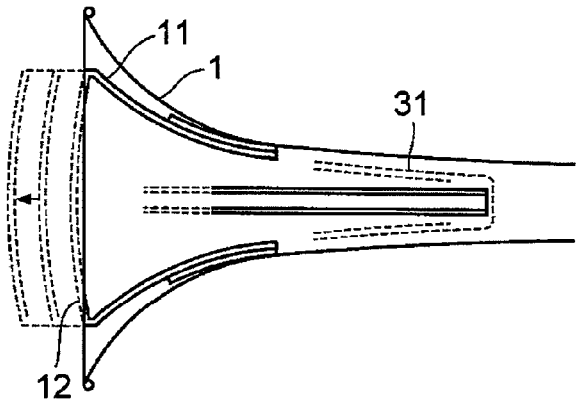
FIG. 7 is a view illustrating an example of changes in the position of the closing portion in the embodiment.

FIG. 6 illustrates changes in intonation where the diameters D1, D3 of the pitch adjuster 31 are reduced from those in the reference state by 2 mm. Specifically, FIG. 6 illustrates changes in intonation in a case where the closing portion 12 is located at the position of the end portion of the bell 1, in a case where the closing portion 12 is located in front of the end portion of the bell 1 by 10 mm, and in a case where the closing portion 12 is located in front of the end portion of the bell 1 by 20 mm, as illustrated in FIG. 7.

Frontward movement of the closing portion 12 extends a body portion of the silencer. Accordingly, pitches in the lower-order mode fall in particular and get closer to proper pitches. In contrast, when the closing portion 12 is moved toward the inside of the bell 1, the pitches in the lower-order mode greatly rise in particular.

It has been found that existing brass instruments such as a tuba, the trumpet, the trombone, and a horn can achieve generally practical intonation even where the end of the silencer is located near the end of the bell 1.

The pitch adjuster 31 is provided in the present embodiment as described above. Accordingly, even in the case where the closing portion 12 as the front end portion of the silencer is located near the end of the bell 1 or on an inner side of the end of the bell 1 in the bell 1, the pitch distortion due to mounting of the silencer can be corrected to a degree causing no problem in practical use, making it possible to achieve enough intonation in the practical range. Detailed explanation is provided below. In the case where the closing portion 12 as the front end portion of the silencer is located near the end of the bell 1 or on an inner side of the end of the bell 1 in the bell 1, even where the pitch adjuster 31 is provided, a small amount of distortion is caused at the resonant frequency in the lower-order mode. The conventional silencer whose front end portion projects from the end portion of the bell 1 can more reliably correct such distortion at the resonant frequency in the lower-order mode. However, the skilled player can correct such distortion at the resonant frequency in the lower-order mode with movement of his or her lips during playing. For the skilled player, a problem of poor usability of the silencer projecting from the end portion of the bell 1 when mounted is more critical than the problem of the distortion at the resonant frequency in the lower-order mode. In the present embodiment, distortion at a resonant frequency in the midrange can be corrected without the front end portion of the silencer projecting from the end portion of the bell 1. Accordingly, it is possible to achieve enough intonation in the practical range with improvement in usability of the silencer. Also, in the present embodiment, since the pitch adjuster 31 is provided without any direct relationships with a mount portion of the silencer (specifically, the shock absorber 11*a*), the pitch adjuster 31 can be applied to various instruments and bells. Also, in the present embodiment, since the silencer fits in the bell 1 of the brass instrument, a simple means can be used for securing the silencer to the bell 1. For example, even the shock absorber 11*a* illustrated in FIG. 1 can reliably secure the main body 10 to the inside of the bell 1 in the state in which the shock absorber 11*a* is sandwiched between the outer circumferential surface of the main body 10 of the silencer and the inner wall of the bell 1. Such construction results in easy mounting of the silencer to the brass instrument in the present embodiment.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. Examples of modifications of the illustrated embodiment are explained below.

(1) In the above-described embodiment, the rod 32 is inserted in the hole of the boss 12*a* of the closing portion 12 and the hole of the boss 31*b* of the pitch adjuster 31 to connect the closing portion 12, the rod 32, and the pitch adjuster 31 to each other, but the connection of these three components is not limited to this method. For example, the present silencer may be constructed such that a male thread is formed on each of opposite ends of the rod 32, a female threaded hole is formed in each of the boss 12*a* and the boss 31*b*, and the male threads formed on the opposite ends of the rod 32 are respectively engaged with the female threaded holes formed in the respective bosses 12*a*, 31*b*. Also, the present silencer may be constructed such that the rod 32, the boss 12*a* of the closing portion 12, and the boss 31*b* of the pitch adjuster 31 are omitted, the end portion 13 of the cylindrical portion 11 and the front end portion 31*a* of the pitch adjuster 31 are connected with a space therebetween by a plurality of thin plate members to secure the pitch adjuster 31. That is, any construction may be employed as long as the breath blown by the player from the mouthpiece is delivered into the cylindrical portion 11 through an area located between the end portion 13 of the cylindrical portion 11 and the front end portion 31*a* of the pitch adjuster 31. Also, the shape of the rod 32 is not limited to the rod shape, and the rod 32 may have any shape as long as the rod 32 can support the pitch adjuster 31 with respect to the main body 10. Also, while the silencer is applied to the brass instrument in the above-described embodiment, the silencer may be applied to a woodwind.

(2) While the hollow pitch adjuster 31 whose front end is open is provided in the above-described embodiment, the front end of the pitch adjuster 31 may not be open. In this construction, the silencer may be constructed such that a hole having the same diameter as the rod 32 is formed in the front end of the pitch adjuster 31, and the rod 32 is inserted into this hole to secure the pitch adjuster 31 to the rod 32.

(3) While the pitch adjuster 31 is mounted as the enlarging portion on the rod 32 in the above-described embodiment, the shape of the enlarging portion may not be the conical trapezoid shape and may be, for example, an ovoid shape. Also, the outer circumferential surface of the pitch adjuster 31 may be a curved surface or a flat surface. Alternately, the enlarging portions having various sizes and shapes may be prepared, and the pitch adjuster may be constructed by an appropriate enlarging portion selected according to, e.g., the shape of the bell of the brass instrument that uses the silencer.

Figure 8:
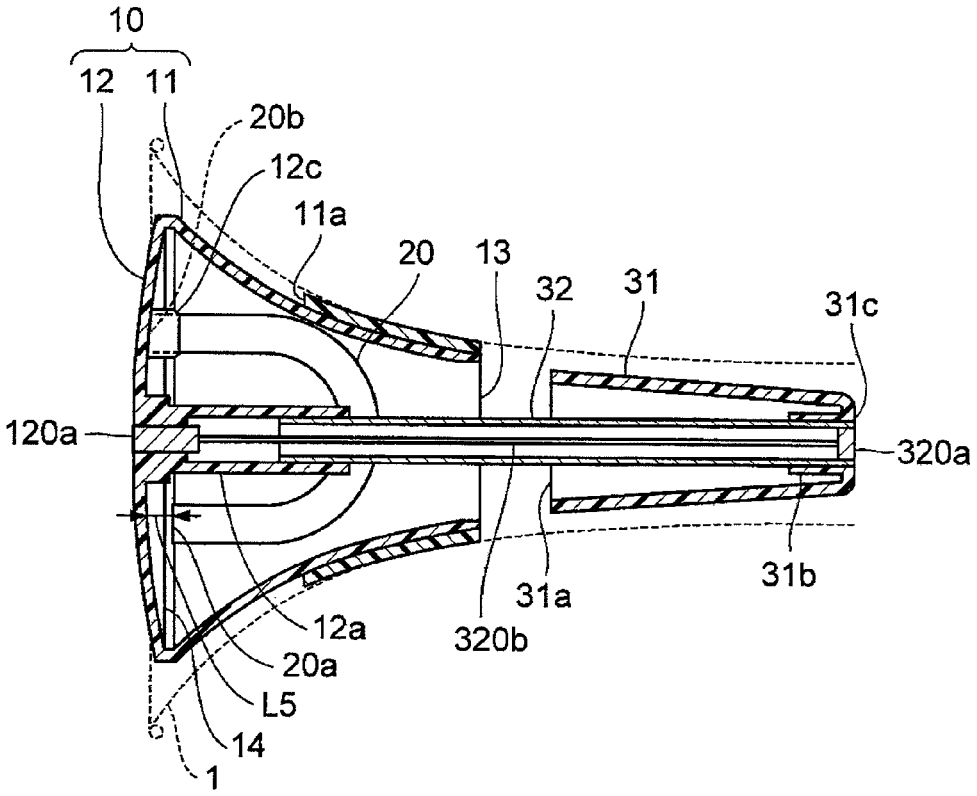
FIG. 8 is a view illustrating a construction of a silencer according to another embodiment of the present invention.

(4) The present silencer may further be constructed such that sounds are collected by a microphone during silencing performed by the silencer, and a specific person, e.g., a player can listen to the collected sounds. FIG. 8 is a view illustrating an example of a construction in which a microphone can be mounted on the silencer. It is noted that the same reference numerals as used in the embodiment illustrated in FIG. 1A are used to designate the corresponding elements of this modification illustrated in FIG. 8, and an explanation of which is dispensed with. In the construction illustrated in FIG. 8, the rod 32 extends through the end portion 31*c* of the interval adjuster 31, and a microphone 320*a* is attached to an end portion of the rod 32. A terminal 120*a* is mounted on a center of the closing portion 12, and a signal line 320*b* is connected to the microphone 320*a* and the terminal 120*a*. When an output signal line connected to, e.g., an amplifier is connected to the terminal 120*a* in a state in which the silencer having this construction is mounted on a bell of a brass instrument, a played sound can be converted to a sound having a desired volume by, e.g., the amplifier while silencing a sound produced by the brass instrument, and a specific person can listen to the sound. It is noted that a position at which the microphone 320*a* is attached is not limited to the end portion of the rod 32, and the microphone 320*a* may be disposed at any place as long as the microphone 320*a* can detect the played sound in the silencer. An output signal of the microphone 320*a* is not necessarily transmitted to, e.g., the amplifier through wired communication and may be transmitted through wireless communication.

What is claimed is:

1. A silencer comprising:

a hollow main body to be inserted in a bell of a wind instrument and comprising a rear end portion serving as an opening portion, and a front end portion serving as a closing portion; and a flow-path adjuster supported by the main body in the bell and configured to narrow a path through which a breath of a player of the wind instrument is delivered into the main body, wherein the front end portion of the main body is located in a vicinity of a frontmost portion of the bell or at a rear of the frontmost portion in a state in which the main body is mounted in the bell.

2. The silencer according to claim 1, further comprising a support member configured to support the flow-path adjuster in the main body.

3. The silencer according to claim 2, wherein:

the support member is a rod whose one end is secured to an inner wall of the front end portion of the main body, and the flow-path adjuster comprises an outer circumferential surface that faces an inner wall of the bell in the state in which the main body is mounted in the bell.

4. The silencer according to claim 1, wherein the flow-path adjuster comprises a closed first rear end portion, a first front end portion, and an outer circumferential surface extending from the first rear end portion to the first front end portion and defining the path of the breath with an inner wall of the bell.

5. The silencer according to claim 4, wherein the flow-path adjuster has a substantially conical trapezoid shape in which an outside diameter of the flow-path adjuster increases in a direction directed from the first rear end portion to the first front end portion.

6. The silencer according to claim 1, wherein an area of the path of the breath changes with a change in position of the flow-path adjuster with respect to the main body in an axial direction of the bell.

7. The silencer according to claim 1, wherein the flow-path adjuster is detachably attached to an inner wall of the front end portion of the main body.

8. The silencer according to claim 3, wherein the flow-path adjuster is detachably attached to the rod.

9. The silencer according to claim 1, wherein:

the main body comprises a terminal, and a signal line extending from a microphone is connected to the terminal.

10. A silencer comprising:

a hollow main body having a shape which is adapted to be inserted in a bell of a wind instrument along a central axis of the bell, the hollow main body comprising an open rear end portion and a closed front end portion; and a pitch adjuster supported by the main body so that it is also located in the bell when the main body has been inserted in the bell, the pitch adjuster being configured to adjust an air path through which a breath of a player of the wind instrument is delivered into the main body.

11. The silencer according to claim 10, further comprising a support member connecting the pitch adjuster to the main body.

12. The silencer according to claim 11, wherein:

the support member is a rod having one end which is secured to an inner wall of the front end portion of the main body; and the pitch adjuster comprises an outer circumferential surface that faces an inner wall of the bell when the hollow main body has been inserted into the bell, the adjusted air path being defined, at least in part, between an inner wall of the bell and the outer circumferential surface of the flow-path adjuster.

13. The silencer according to claim 10, wherein the pitch adjuster comprises a closed rear end portion, a front end portion, and an outer circumferential surface extending from the rear end portion to the front end portion, the adjusted air path being defined between an inner wall of the bell and the outer circumferential surface of the pitch adjuster when the silencer has been inserted into the bell.

14. The silencer according to claim 13, wherein the pitch adjuster has a substantially conical trapezoid shape whose diameter increases in a direction directed from the rear end portion to the front end portion.

15. The silencer according to claim 10, wherein a cross-sectional area of the adjusted air path changes as a function of the degree to which the silencer has been inserted into the bell.

16. The silencer according to claim 10, wherein the pitch adjuster is detachably attached to the main body.

17. The silencer according to claim 12, wherein the pitch adjuster is detachably attached to the rod.

18. The silencer according to claim 10, wherein the main body comprises a terminal and a signal line extending from a microphone is connected to the terminal.

19. The silencer according to claim 16, wherein the pitch adjuster is detachably attached to an inner wall of the front end portion of the main body.

* * * * *